US010202744B2

(12) United States Patent
Patterson et al.

(10) Patent No.: US 10,202,744 B2
(45) Date of Patent: Feb. 12, 2019

(54) FLEXIBLE, CONSTANT-DOWNWARD-PRESSURE OBSTRUCTED PIPING CLEARING SYSTEM

(71) Applicants: Roy C. Patterson, Glendale, AZ (US); Darla K Patterson, Glendale, AZ (US)

(72) Inventors: Roy C. Patterson, Glendale, AZ (US); Darla K Patterson, Glendale, AZ (US)

( * ) Notice: Subject to any disclaimer, the term of this patent is extended or adjusted under 35 U.S.C. 154(b) by 0 days.

(21) Appl. No.: 15/657,183

(22) Filed: Jul. 23, 2017

(65) Prior Publication Data

US 2018/0127962 A1 May 10, 2018

Related U.S. Application Data

(60) Provisional application No. 62/393,020, filed on Sep. 10, 2016.

(51) Int. Cl.

| | |
|---|---|
| ***E03D 11/00*** | (2006.01) |
| ***E03C 1/302*** | (2006.01) |
| ***B08B 9/043*** | (2006.01) |

(52) U.S. Cl.
CPC ..... *E03C 1/302* (2013.01); *B08B 9/0436* (2013.01)

(58) Field of Classification Search
CPC ..... B08B 9/0436; E03C 1/302
USPC ..... 4/255.01
See application file for complete search history.

(56) References Cited

U.S. PATENT DOCUMENTS

| | | | | |
|---|---|---|---|---|
| 2,668,974 A * | 2/1954 | Jaeger | ..... | A47K 11/10 15/210.1 |
| 4,644,603 A | 2/1987 | Meyer | | |
| 5,471,697 A | 12/1995 | Daconta | | |
| 6,295,688 B1 * | 10/2001 | Sayles | ..... | A47K 11/10 15/104.94 |

(Continued)

FOREIGN PATENT DOCUMENTS

| | | |
|---|---|---|
| CN | 2293601 | 10/1998 |
| CN | 204662597 | 9/2015 |

(Continued)

OTHER PUBLICATIONS

International Search Report, dated Aug. 21, 2018 for PCT/US2018/033937.

*Primary Examiner* — Huyen Le
(74) *Attorney, Agent, or Firm* — Arno Naeckel; Patented PLLC

(57) ABSTRACT

A system and a tool for clearing an obstructed pipe or drain is presented. The system comprises the tool and a housing. The tool comprises a plunger and a protective sleeve with a closed end. The plunger comprises a dowel shaped flexible portion and a dowel shaped rigid handle portion, the distal end of the rigid handle portion being fixedly attached to the proximate end of the flexible portion by a connection device. The protective sleeve is comprised of a water soluble material that is configured to conform to the shape of the dowel shaped flexible portion and at least a portion of the dowel shaped rigid handle portion when the flexible portion is inserted therein, the water soluble material being chemically formulated and mechanically formed to maintain watertight integrity when submerged in water. The housing is configured to store the plunger and the protective sleeve when not in use.

20 Claims, 11 Drawing Sheets

(56) References Cited

U.S. PATENT DOCUMENTS

| | | | | |
|---|---|---|---|---|
| 7,124,450 | B2 * | 10/2006 | Davidson | E03D 9/00 4/255.11 |
| 7,281,278 | B1 | 10/2007 | Biagi | |
| 9,015,890 | B1 | 4/2015 | Owens | |
| 9,226,628 | B2 * | 1/2016 | Morrison, Jr. | A47K 11/10 |
| 9,441,353 | B1 | 9/2016 | Hamil | |
| 2004/0129296 | A1 | 7/2004 | Treacy et al. | |
| 2004/0172749 | A1 | 9/2004 | Davidson | |
| 2005/0125922 | A1 | 5/2005 | Szarawarski | |
| 2007/0143912 | A1 | 6/2007 | Thorp | |
| 2009/0049593 | A1 | 2/2009 | Hodkiewicz | |
| 2009/0293185 | A1 | 12/2009 | Falcon | |
| 2010/0252071 | A1 | 10/2010 | Bounds | |
| 2011/0010832 | A1 | 1/2011 | Tsiros | |
| 2011/0030173 | A1 | 2/2011 | Overgaard | |
| 2012/0011643 | A1 | 1/2012 | Schultz | |

FOREIGN PATENT DOCUMENTS

| | | |
|---|---|---|
| JP | 0580398 | 11/1993 |
| WO | 2016116913 | 7/2016 |

* cited by examiner

FIG. 6
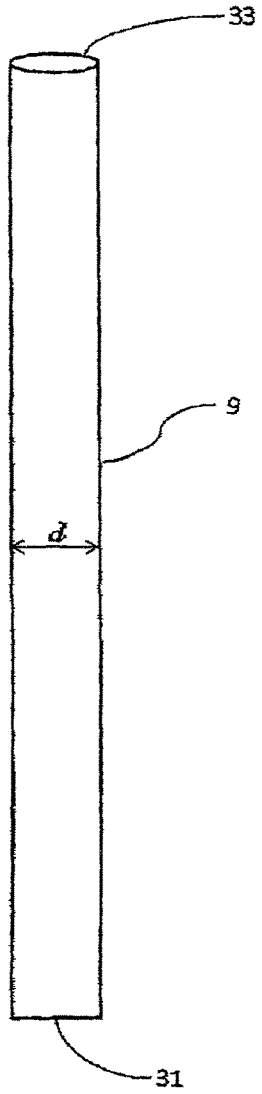
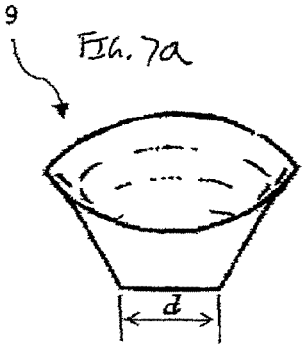
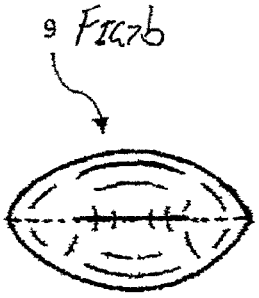

FLEXIBLE, CONSTANT-DOWNWARD-PRESSURE OBSTRUCTED PIPING CLEARING SYSTEM

CROSS-REFERENCE TO RELATED APPLICATION

This utility application is related to and claims priority benefit from co-owned provisional application Ser. No. 62/393,020, which was filed Sep. 10, 2016, and is incorporated herein by reference in its entirety.

BACKGROUND OF THE INVENTION

The present subject matter relates to the field of plumbing and more specifically to the art of clearing obstructed drain piping. Currently there are a number of devices known in the art designed to clear piping obstructions. Some of these solutions attempt to use compressed air pressure or vacuum suction via a plunging motion to clear the obstruction. However, these solutions fail to meet the needs of the consumer because they don't resolve the water-displacement or cleanliness issues that users experience.

Other solutions attempt to use a mechanical snake-like device, but these solutions are similarly unable to meet the needs of the industry because these devices require a measure of mechanical competency and still result in dirty-water-displacement, dirty-water-splashing, and general long-term cleanliness issues of the devices.

Still other solutions seek to resolve the issue with adhesive coverings that trap air. However, these solutions also fail to meet industry needs because users must clean the rim before applying the adhesive barrier. In addition, these devices are not conducive to a living environment, such as a bathroom, and must be kept stored in such a way that they are not necessarily close to the obstructed pipe and increase the possibility of water overflow issues.

It would be desirable to have a device that is an alternative to the generally-accepted plunging/snaking/air-trapping devices used to clear an obstruction from a toilet discharge or other drain. Further, it would also be desirable that this alternative device be capable of preventing back splash or, as it is more commonly understood, splashing dirty water all over the user and the floor/carpet/rug as a result of the standard up/down plunging technique or the general displacement of water that occurs when a standard plunger is inserted into a full bowl of dirty toilet water, causing excess spillage onto the floor before the drain is cleared.

Furthermore, it would also be desirable to have a device that can, optionally, be kept clean and dry during the process of clearing an obstruction thereby minimizing clean-up or the transference of bacteria to other areas.

Further still, it would be desirable to have a device that is small and easy to store and/or display next to the obstruction-prone drain or pipe for quick access and use. In addition, it would be desirable to have a device that does not require mechanical or physical dexterity to operate. Therefore, there currently exists a need in the industry for an alternative device and associated method that will clear an obstructed drain or pipe without splashing, that can remain clean and dry during and after use, that can be stored or displayed nearby for quick access and immediate use, and is simple and easy to use, not requiring substantial strength, dexterity or hand/eye coordination efforts to accomplish the task.

BRIEF SUMMARY OF THE INVENTION

A pipe clearing system is presented comprising a plunger, a protective sleeve with an open end and a closed end, and a housing configured to house the plunger and the protective sleeve when not in use. The plunger comprises a dowel shaped, non-rotatable flexible portion with a proximate end and a distal end and a dowel shaped rigid handle portion with a proximate end and a distal end and a length therein between, the distal end of the rigid handle portion being fixedly attached to the proximate end of the flexible portion by a connection device. The protective sleeve is comprised of a water soluble material that is configured to conform to the shape of the dowel shaped flexible portion and at least a portion of the dowel shaped rigid handle portion when the flexible portion is inserted therein, the water soluble material being chemically formulated and mechanically formed to maintain watertight integrity for at least 15 seconds when submerged in water.

Other embodiments include a pipe clearing tool comprising a protective sleeve with an open end and a closed end and a plunger removably inserted into the protective sleeve. The plunger comprises a dowel shaped flexible portion with a proximate end and a distal end and a dowel shaped rigid handle portion with a proximate end and a distal end and a length therein between, the distal end of the rigid handle portion being fixedly attached to the proximate end of the flexible portion by a connection device. The protective sleeve is comprised of a water soluble material that conforms to the shape of the dowel shaped flexible portion and at least a portion of the rigid handle portion when the flexible portion is inserted therein, the water soluble material being chemically formulated and mechanically formed to maintain its watertight integrity for at least 15 seconds when submerged in water.

Still other embodiments include a pipe clearing tool comprising a protective sleeve with an open end and a closed end and a plunger removably inserted into the protective sleeve. The plunger comprises a dowel shaped flexible portion with a proximate end and a distal end and a dowel shaped rigid handle portion with a proximate end and a distal end and a length therein between, the distal end of the rigid handle portion being fixedly attached to the proximate end of the flexible portion by a connection device and the proximate end having a crossbar attached thereto with two projecting ends. The protective sleeve is comprised of a water soluble material that is configured to conform to the shape of the dowel shaped flexible portion and at least a portion of the rigid handle portion when the flexible portion is inserted therein, the water soluble material being chemically formulated and mechanically formed to maintain its watertight integrity for at least 15 seconds when submerged in water.

BRIEF DESCRIPTION OF THE DRAWINGS

The figures which accompany the written portion of this specification illustrate embodiments and method(s) of use for the present invention constructed and operative according to the teachings of the present invention.

FIG. 6 is a side view of a protective sleeve.

FIGS. 7*a* and 7*b* are a perspective view and a top view of a partially opened end of a protective sleeve, respectively.

The various embodiments of the present invention will hereinafter be described in conjunction with the appended drawings, wherein like designations denote like elements.

DETAILED DESCRIPTION

The present invention advantageously fills the aforementioned deficiencies by providing a flexible constant-downward-pressure pipe clearing device that includes a partially-flexible plunger or stick-like device that may preferably range between 2' and 4' in length and can be inserted into an obstructed toilet, drain, siphon, or pipe to clear the obstruction.

Figure 1:
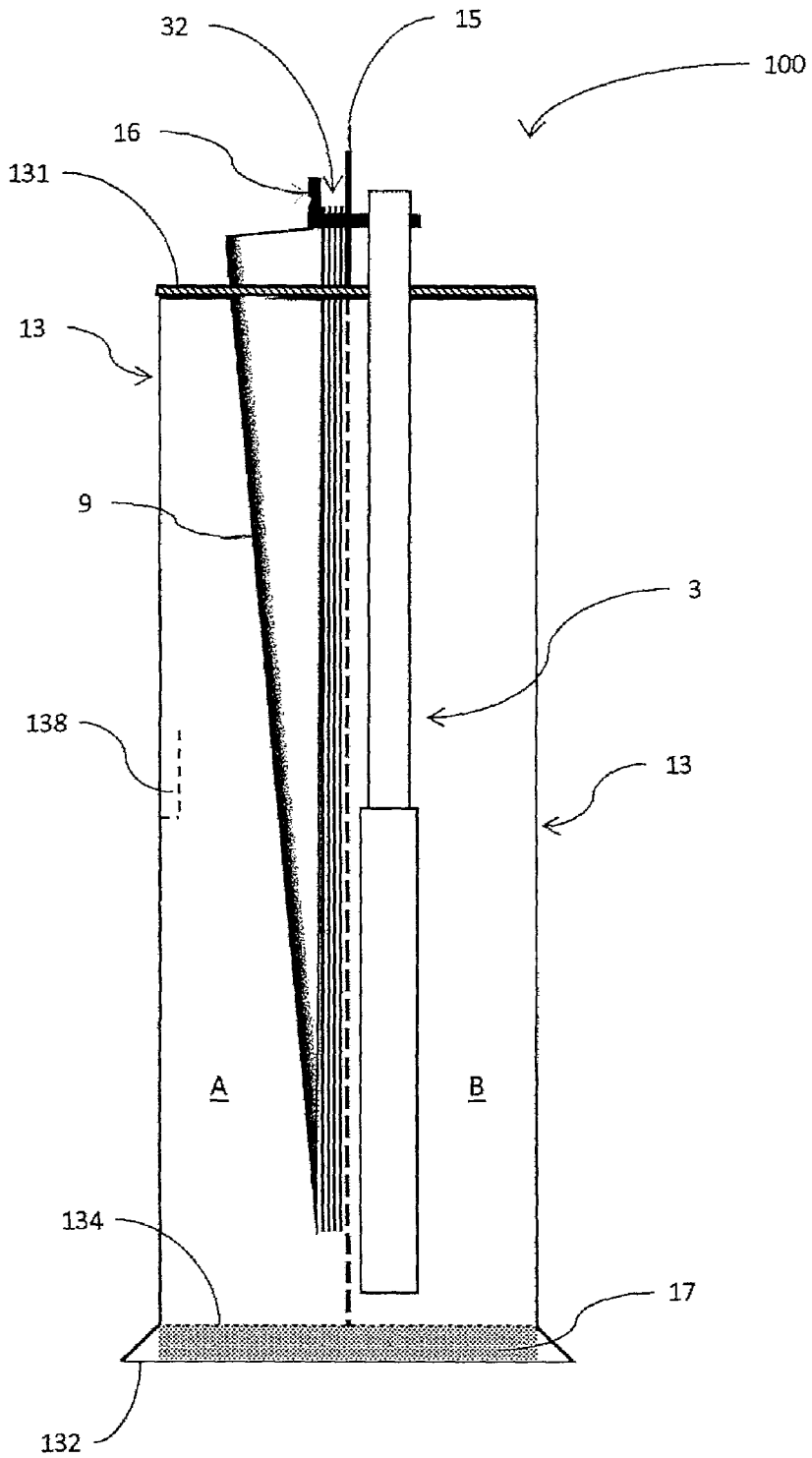
FIG. 1 is a cut away side view of an exemplary embodiment of the Flexible, Constant-Downward-Pressure Obstructed Pipe Clearing System.
Figure 19:
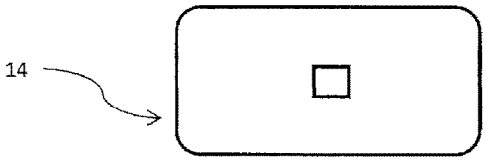
FIGS. 19 and 20 are a side view of an exemplary top cover for the housing of FIG. 18.
Figure 18:
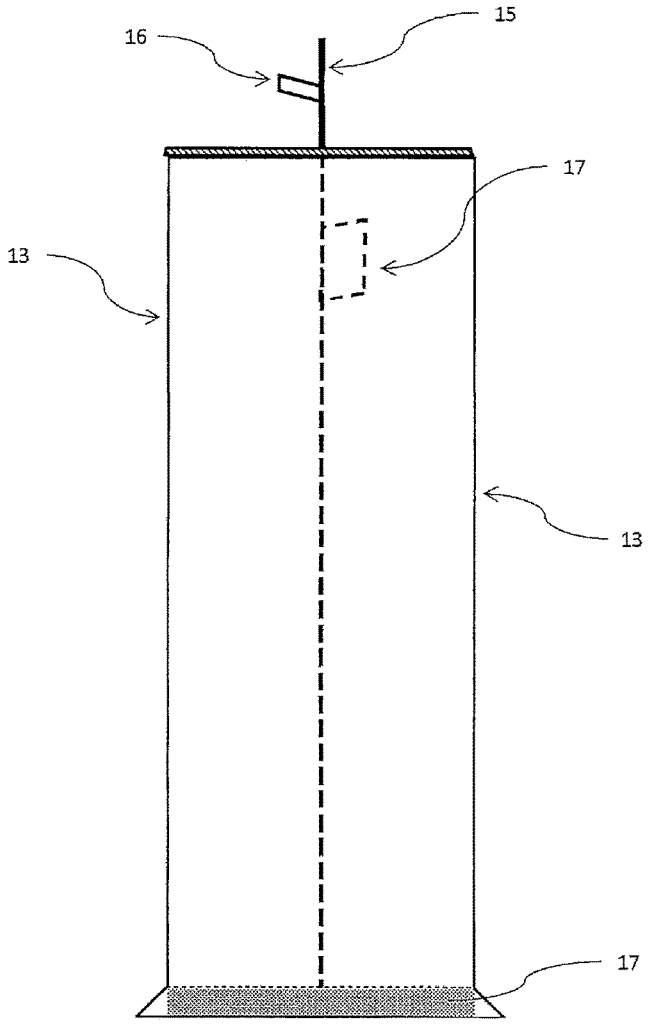
FIG. 18 is a side view of the housing embodiment of FIG. 17.
Figure 20:
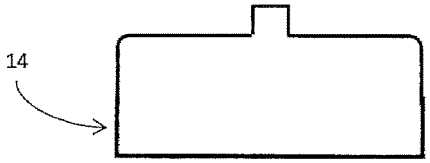

FIG. 1 depicts a cross sectional side view of the Flexible, Constant-Downward-Pressure Obstructed Piping Clearing System (the "System") 100. The System comprises a housing 13 with an open top edge 131, a bottom end 132 and a cover (See FIGS. 19-20) to enclose the top edge. The housing 13 may be of any suitable shape such as a cylinder or a parallelepiped large enough to contain a plunger 3 and protective sleeves 9.

The bottom end of the housing 132 is closed by a bottom 134. The bottom 134 may be a simple bottom with a diameter equal to the diameter of the housing 13, or it may have a diameter that is larger than the diameter of the housing 13. The bottom portion 134 may be flared as shown in FIG. 1 or it may have a constant diameter as shown by the grayed area 134. The bottom portion 132 may also include a weight 17 to facilitate an upright positioning.

The housing 13 may also include an interior wall 15 that extends from the bottom 134 upward and above the top edge 131. The wall 15 separates the interior of the housing into two sections A (e.g., storing protective sleeves 9) and B (storing plunger 3) and is preferably a solid wall in order to minimize water vapor from migrating from one section into the other. To that end, the section (AB) that stores the protective sleeves 9 (See, FIG. 6) may also include a "pocket" 138 fixedly attached to the wall 15, the cover (not shown), the bottom 134, or it may be attached to the interior of the housing 13. The "pocket" may be configured to contain a desiccant. Further, the wall 15 comprises a hook or a peg 16 attached to, or through, its top end. The plunger 3 and one or more protective sleeves 9 for the plunger 3 may be hung from hook/peg 16.

The configuration of the housing 13 allows the plunger 3 and the packet of protective sleeves 9 to hang freely for easy accessibility, but it will also provide a way for the primary device to be quickly removed and inserted into a fresh, protective sleeve for immediate use in an emergency overflow situation. The housing also protects the stored protective sleeves from accidental exposure to liquid that may cling to the plunger 3 itself or the re-usable sleeve or from liquid that might be splashed toward the housing from an external source.

Figure 2:
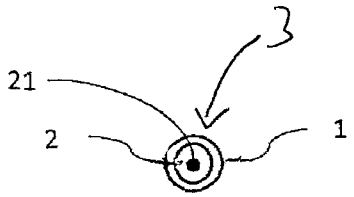
FIG. 2 is a top view of an exemplary plunger in an embodiment.
Figure 3:
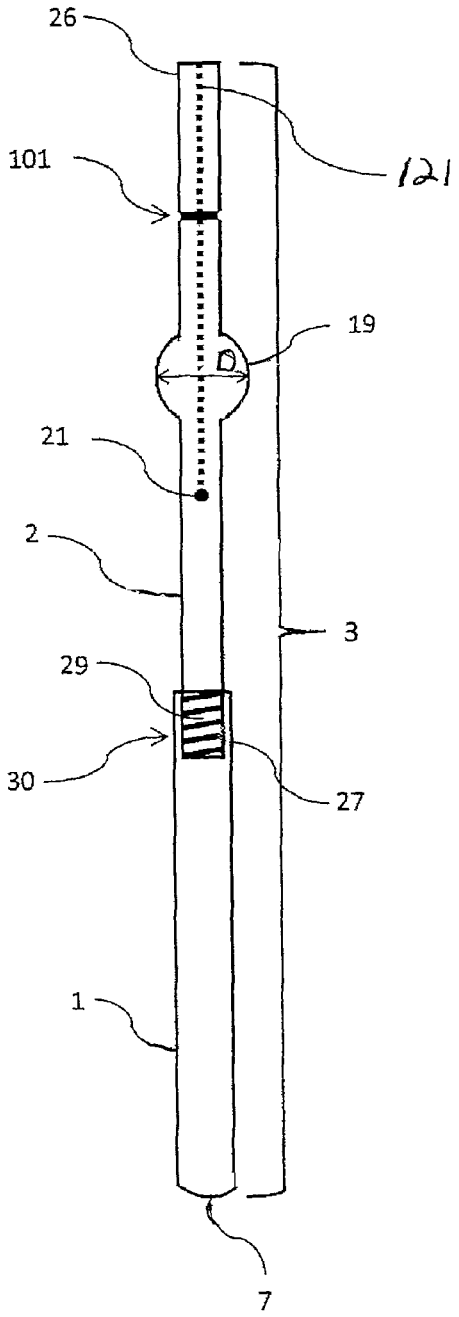
FIG. 3 is a side view of the plunger in an embodiment.
Figure 4:
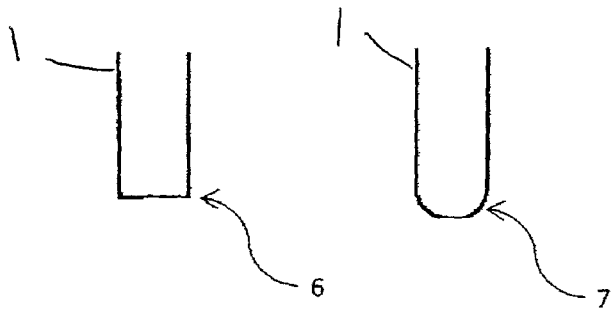
FIG. 4 depicts non-limiting examples of the closed distal ends of the flexible portion of the plunger.
Figure 21:
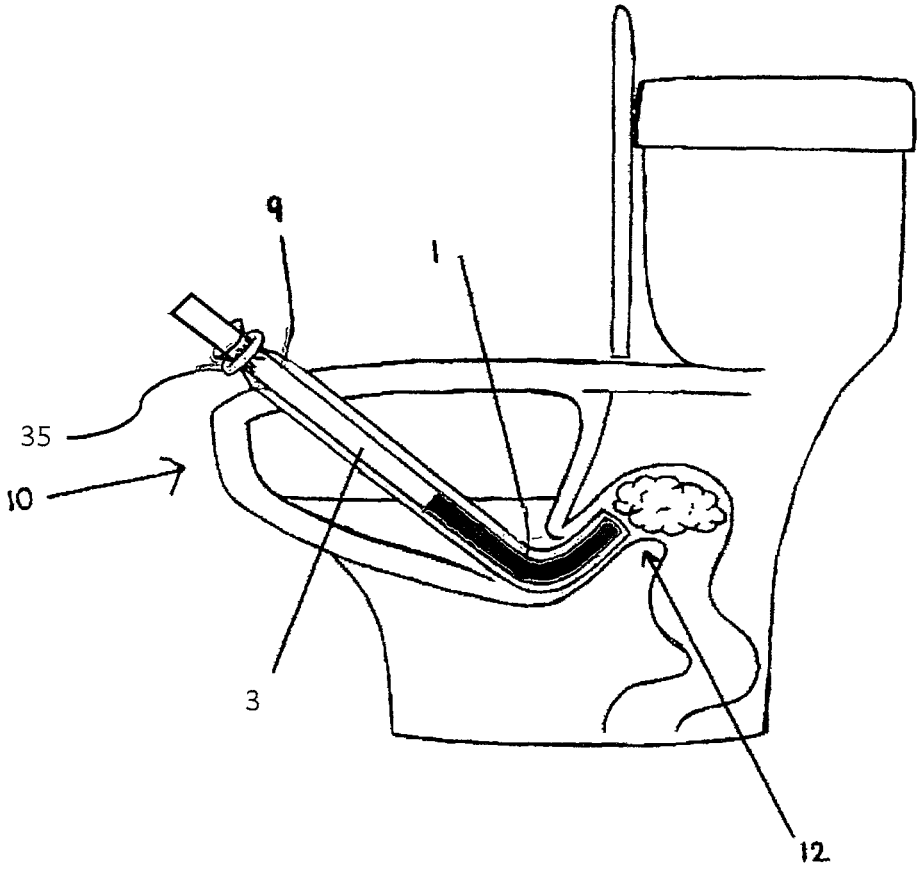
FIG. 21 is a cross-sectional view of a toilet with the plunger in use.

FIGS. 2-3 present a top view and side view of the plunger 3, respectively. The plunger 3 is a composite rod with rigid handle 2 and a flexible bottom portion 1. The flexible bottom portion 1 is made of a flexible elastomeric, a plastic, plastic composite, rubber, rubber composite or plastic/composite/metal/rubber combination material that provides a suitable flexibility in navigating the curvature of a drain or pipe or s-trap/p-trap 12 (See, FIG. 21) while maintaining sufficient rigidity to prevent flexible portion from doubling over, kinking, or collapsing due to the downward compression/pressure required to force the obstruction through the drain. The flexible portion is resilient such that it returns to its original shape after use and may include an embedded spring (not shown) to that end. The flexible bottom portion 1 has a closed distal end 7 and a proximal end 27. FIG. 4 depicts several exemplary, non-limiting closed distal end shapes (6-7).

Figure 5:
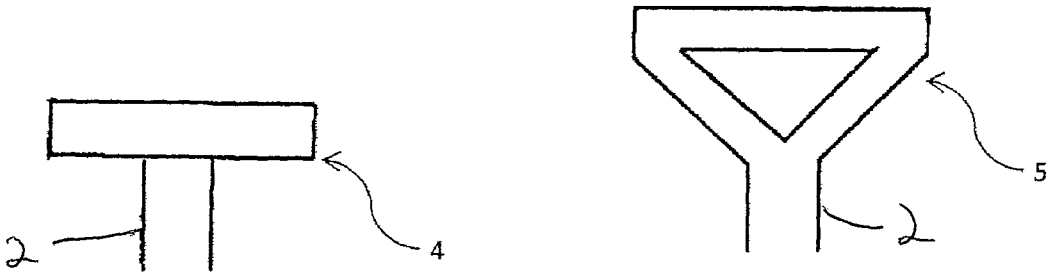
FIG. 5 depicts non-limiting examples of handles attached to the rigid handle portion of the plunger.

The top portion 2 of the plunger 3 is a rigid handle portion 2 with a proximal end 26 that accommodates a stable grip for pushing the device into the obstruction and for pulling the device out after the obstruction has been cleared. The rigid handle portion 2 may include a bulge or a prominence in diameter 19 that has a maximum diameter D. The rigid handle portion may also have an incised notch 101 circumscribing the handle portion 2. FIG. 5 depicts additional exemplary, non-limiting examples of a rigid handle in addition to the "broomstick" configuration depicted in FIGS. 1 and 3.

The rigid top portion 2 also has a distal end 29 that is fixedly attached to the proximal end 27 of the flexible bottom portion 1 by a connection device 30. The connection device 30 may be any suitable device that currently exists or that may be developed in the future. An exemplary connection device 30 may be a land and groove device with lands formed on one portion mating with grooves formed into the other portion in a screw like manner. Other non-limiting, exemplary connection devices may include a simple protrusion and socket held together by an adhesive or by a friction fit; may include a pin-and-hole configuration; or may include a spring loaded protrusion-in-hole arrangement. However, the distal end 29 of the rigid handle portion 2 and proximal end 27 of the flexible portion 1 may be fixedly and non-rotatably attached by any means known in the art that would be suitable for the materials being used. It should be noted that the differing diameters of the rigid handle portion 2 and the flexible portion 3, are merely exemplary of an embodiment for clarity of disclosure herein. The diameters of both portions may be formed to be the same as is known in the art, if so desired.

As a non-limiting example of an embodiment, the plunger 3 may be approximately 30 inches long and one inch in diameter with the rigid handle portion 2 being 18.5 inches long and one inch wide and the flexible bottom portion being approximately 13 inches long and 1.5 inches wide. The connection device 30 may be approximately 1.5 inches long and overlap portions of the rigid handle 2 and flexible portion 1.

Some embodiments may also include a protective sleeve 9 (See, FIG. 6) into which the plunger 3 is inserted prior to clearing an obstruction. The protective sleeve 9 maintains the device in a clean and dry condition during the obstruction-clearing process.

In embodiments disclosed herein, the protective sleeve has an open end 33 and a closed end 31. The protective sleeve 9 also has a diameter (d), where diameter (d) may be slightly smaller than the diameter D of the prominence 19 in the rigid handle 2 in some embodiments, discussed above (See FIG. 3). As such, the protective sleeve 9 be may elastically pulled over the prominence 19 such that the sleeve 9 may be frictionally secured to handle 2. Further, protective sleeve 9 may include a flared opening the diameter of which may be large enough accept and partially (or completely) cover a user's hand as a shield.

The protective sleeve 9 in some embodiments might be composed of a non-soluble plastic film or sheet. In other embodiments, the protective sleeve may be composed of a water-soluble material. Such a water soluble material may be a Polyvinyl Alcohol (PVOH) polymer or a PVOH copolymer that can be discarded into the drain immediately after the obstruction has been cleared and will disintegrate in water within a predetermined amount of time. The protective sleeve 9 may also be comprised of a layer(s) of easily dissolvable paper in combination with, and alternating with, a layer(s) of PVOH. The paper layer(s) may impart various effects such as adjusting the dissolution time of the protective sheath and adding structural integrity. Further, the paper layer may be impregnated or coated with a desiccant to mitigate water vapor contact with the adjacent water soluble material during storage.

The dissolvability of a sheet of water soluble material such as PVOH may be engineered such that the protective sleeve 9 may be immersed in water for a specific predetermined time without losing its structural integrity. Dissolvability depends on the temperature of the water, the thickness of the PVOH, its physical construction and the specific chemical makeup or "brand" of the PVOH. Elasticity (i.e., tensile mechanical properties) of solid PVOH may be adjusted by crosslinking different amounts and types of a co-polymer(s), such as polyurethane, and still maintain its dissolvability. The protective sleeve 9 is formulated and configured to maintain its mechanical integrity while submerged in water for a reasonable amount of time to complete the clearing of the obstruction. Such a time may range between 15 seconds and 24 hours, more preferably range between 30 seconds and 10 minutes and even more preferably about 1 minute.

The protective dissolvable polymer sleeve material need not be of uniform thickness. The thickness of the protective sleeve 9 may be greater in some areas where marked stress and strain may be experienced during use of the plunger 3 such as the closed distal end 31 of the protective sleeve 9 that comes in contact with, and may be compressed and/or abraded between, the obstruction and the distal end 7 of the flexible portion 1. Other thicker areas (or multiple sheets) may be located where it is most likely that the rigid portion 2 may be grasped when and if the user's hand is not located inside the protective sleeve. The protective sleeve 9 may also have a perforated tab 32 projecting above the open edge of the protective sleeve 9. The perforation allows the protective sleeve 9 to be hung from the hook/peg 16.

In some embodiments, the rigid handle 2 may include a gas vent 121 with an inlet perforation 21 penetrating the circumferential surface of the rigid handle at a point along its length that would be normally located inside the protective sleeve 9 when attached. The perforation 21 therefore may be located below the portion of the rigid handle 2 having a diameter D. The vent 121 extends upward inside the rigid handle 2 from perforation 21 to a convenient outlet point above the furthest reach of the protective sleeve 9. The purpose of the vent 121 is to vent any air captured inside the protective sleeve 9 to the atmosphere such that a ballooning effect inside the protective sleeve 9 does not develop when the plunger 3 is inserted and submerged into a drain containing a liquid. A ballooning effect may cause a sleeve to burst or develop a leak.

In still other embodiments, the rigid handle 2 may be tapered along portions of its length such that the distal end (i.e., the lower end) of the tapered portion has a wider diameter (or width) than does a more proximal end (i.e., the upper end). The rigid handle 2 may also support a slidable ring 35 that has an internal diameter that is greater than diameter d of the protective sleeve 9 and equal to diameter D of the prominence 19.

The slidable ring 35 moves down the rigid handle 9, over the open end of the protective sleeve 9, and serves to frictionally secure the open end of the protective sleeve 9 against the surface of the rigid handle 2 at a location where the internal diameter of the rigid handle 2 is of diameter D. It will be evident to a skilled artisan that using a slidable ring is only one exemplary method of securing the protective sleeve 9 to the rigid handle 2. Other suitable methods and devices for securing the protective sleeve 9 to the rigid handle 2 may be adapted for use with the disclosed subject matter herein. It would also be evident that the rigid handle 2 may have a cross sectional shape other than a circle. It could be a square, triangle or another shape without departing from the scope of this disclosure. The slidable "ring" discussed above would then be of a commensurate shape. The slidable ring 35 may be normally housed in a circumferential notch 101 until required.

Figure 8:
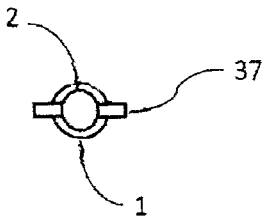
FIG. 8 is a top view of the plunger in an embodiment.
Figure 9:
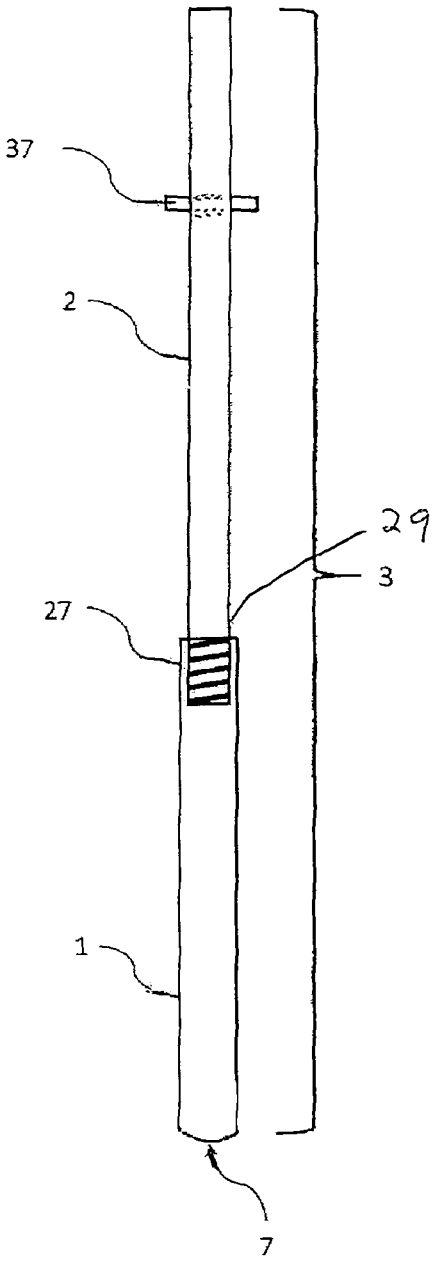
FIG. 9 is a side view of the plunger in an embodiment.
Figure 10:
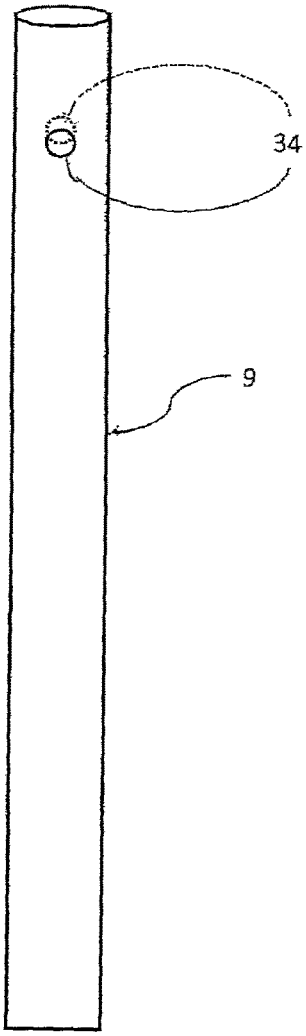
FIG. 10 is a side view of an opened protective sleeve in an embodiment.
Figure 11:
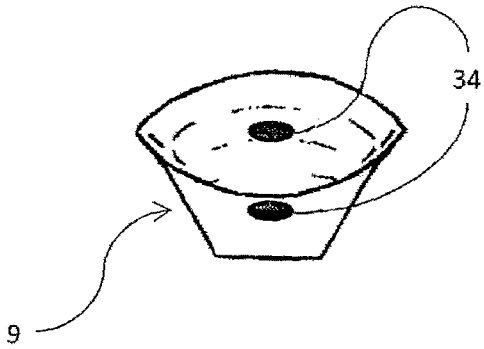
FIG. 11 is a perspective view of the partially opened end of a protective sleeve in an embodiment.
Figure 12:
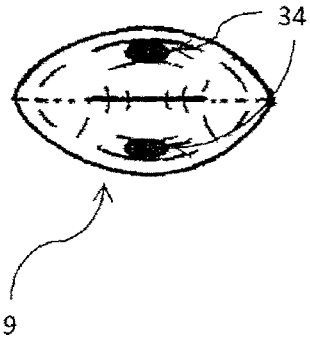
FIG. 12 is top view of the partially opened end of a protective sleeve of FIG. 11 in an embodiment.
Figure 13:
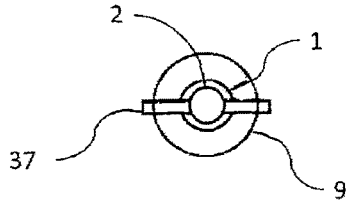
FIG. 13 is a top view of a plunger inserted into a protective sleeve in an embodiment.
Figure 14:
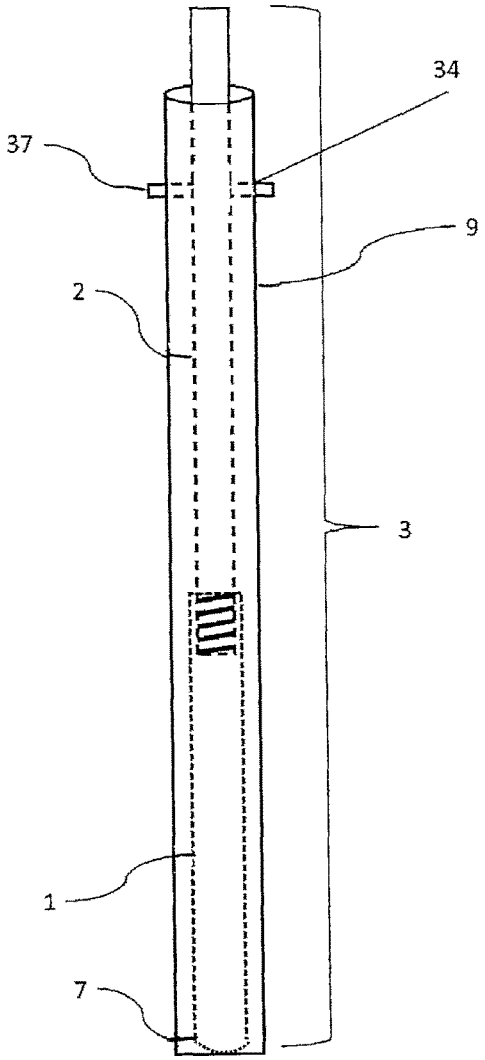
FIG. 14 is a side view of the plunger inserted into a protective sleeve in an embodiment.

In alternative embodiments (See, e.g., FIGS. 8-9) the rigid handle 2 of plunger 3 may include a crossbar 37 that perpendicularly penetrates the rigid handle 2, or may have two pegs perpendicularly affixed to the rigid handle portion. It should be noted the pegs may be replaced in favor of hooks, or the pegs may be inclined upward slightly. The crossbar 37 or its alternatives are positioned at a location along the length of the rigid handle 2 that coincides with two diametrically opposed holes (reinforced or otherwise) in the protective sleeve 9 (See, FIGS. 10-12). In some exemplary, non-limiting embodiments the crossbar 37 may be located approximately 5 inches from the extreme proximate end of rigid handle portion and may preferably protrude from between 0.25 to 0.5 inches from its surface. The crossbar 37 serves to secure the protective sleeve 9 to the rigid handle portion 2, when the rigid handle portion has been inserted within the sleeve for use (See, FIGS. 13-14).

Figure 15:
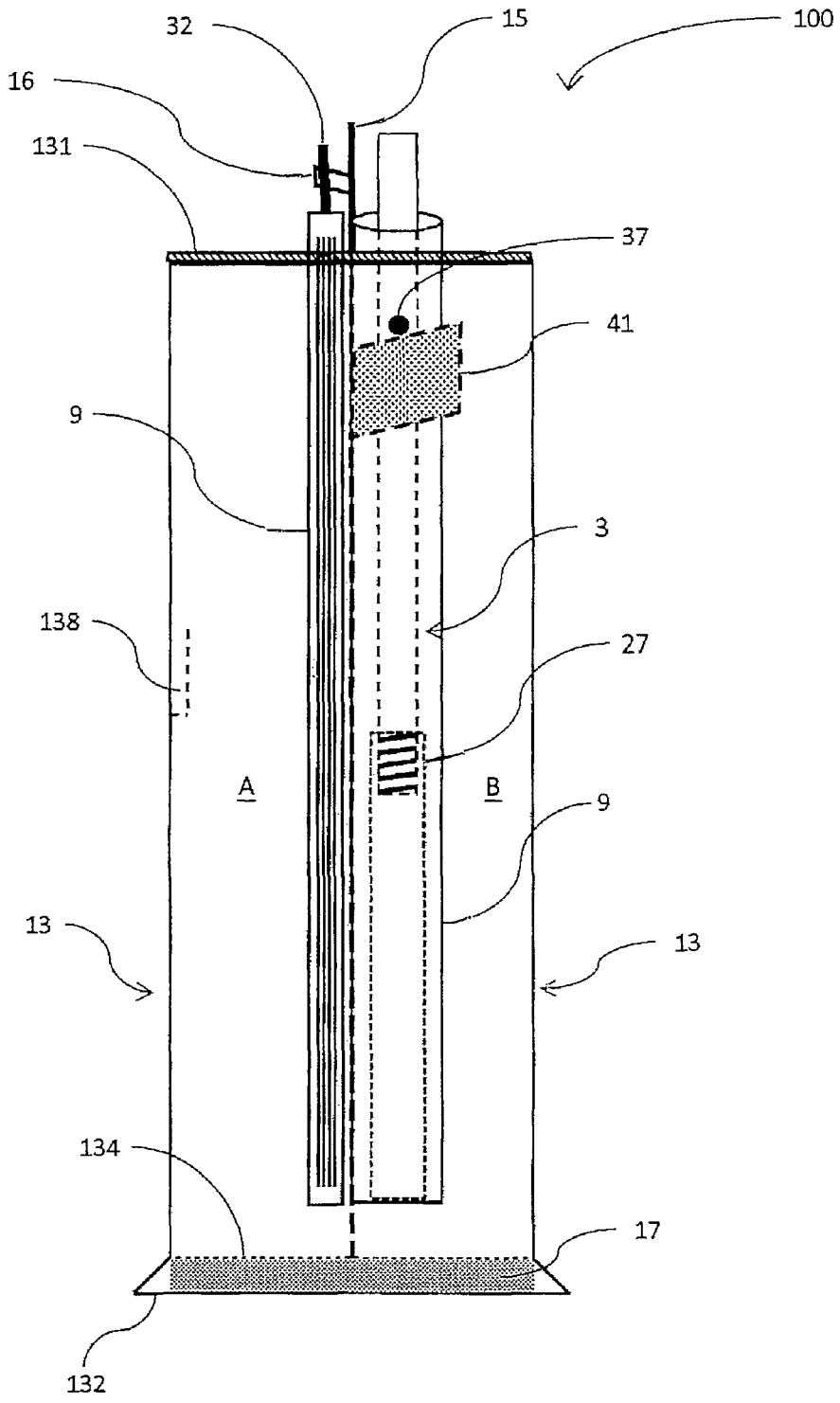
FIG. 15 is a cut away side view of an exemplary embodiment of the Flexible, Constant-Downward-Pressure Obstructed Pipe Clearing System.
Figure 16:
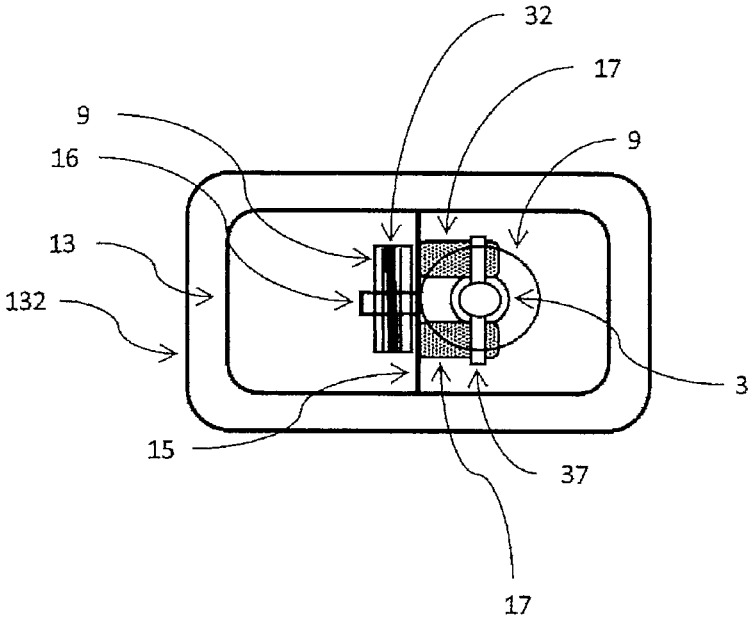
FIG. 16 is a top view of the Flexible, Constant-Downward-Pressure Obstructed Pipe Clearing System embodiment of FIG. 15.
Figure 17:
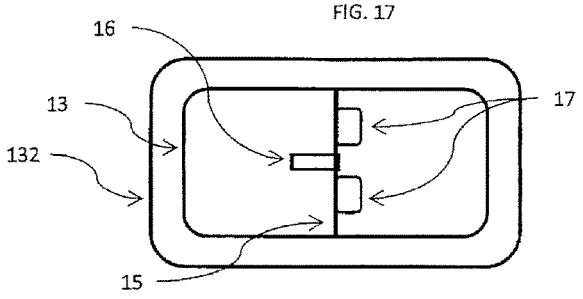
FIG. 17 is a top view of the housing in an embodiment.

FIG. 15 is a similar cross sectional side view of the system to that depicted in FIG. 1 with the exception that the rigid handle portion 2 comprises the cross bar 37 and the wall 15 of the storage housing 13 includes two arms 41. The arms 41 may be pegs, blocks or any other member extending substantially perpendicular from the wall 15 such that the cross bar 37 of the rigid handle portion 2 is supported in a stable manner. As such, the arms 41 may be angled slightly upward to prevent the rigid handle portion from sliding off. FIG. 16 is a top view of the embodiment of FIG. 15 without a top cover (not shown).

The constant-downward-pressure, flexible, clogged-pipe clearing system 100 is easy to use. The plunger 3 and protective sleeves 9 may be stored in the decorative housing next to the toilet in the bathroom. In the event the toilet becomes clogged, a user may remove the plunger 3 (fitted with or without the re-usable plastic or vinyl sleeve) from the housing 15. The user will then insert the flexible portion 1 into the waiting protective water-soluble sleeve 9 that is hanging on peg/hook 16 and secure the protective sleeve 9 to the rigid handle portion 2 with slidable ring 35 or other securing device 30, if provided. If a securing device is not provided, then a manual grip may keep the protective sleeve in place.

The user then inserts the closed end of the flexible portion 1 (which is covered by the protective sleeve 9) into the toilet bowl 10 (See, FIG. 21) and pushes it down, past any p-trap bend 12 and into the obstruction which will usually be composed of toilet paper and/or human waste. The flexible portion will conform to any bend in the piping as it is encountered and return to its original shape when removed.

The user continues to exert force in a downward direction, pushing the flexible, protective-sleeve-covered, flexible portion 1 through the obstruction thereby opening a hole to allow water to drain and pull the remaining portion of the obstruction with it through the natural force of gravity. Once the obstruction has been cleared, the user will pull the plunger 3 back up out of the drain and then release the water-soluble protective sleeve 9 thereby letting the used protective sleeve fall into the water where it will dissolve on its own and be properly disposed with the next flush.

At this point, the user can return the "clean and dry" plunger 3 to the housing 15 to be stored until the next time it is needed without the need for wiping it down, disinfecting, or cleaning up the dirty water that drips from a standard wet plunger or snake when returning it to its holder. Nor does the user have to live with a potentially dirty, crusty plunger sitting next to the toilet. It should be noted that this device does not utilize the standard up/down plunging technique required with standard plungers. Rather, it utilizes a simple, downward force against the obstruction. This reduces the risk of splash and overflow of water from the toilet in addition to maintaining a dry device that minimizes potential cleanup.

The flexibility of the device allows the flexible portion 1 of the plunger 3 to bend through the first curve of a pipe or s-trap/p-trap, if it becomes necessary to do so. The plunger 3 will also retain a level of rigidity that still gives it the ability to withstand the downward force without losing its form and buckling under the exertion. Hence, a rounded closed end 7 and a reinforcement (i.e., thickening) of the protective sleeve 9 in that area are preferred.

The foregoing detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connected" or "coupled to" used in describing a relationship between different elements do not imply that a direct physical connection must be made between these elements unless so stated. For example, two elements may be connected to each other physically, electronically, logically, or in any other manner, through one or more additional elements.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A pipe clearing system comprising:

a plunger;

a protective sleeve with an open end and a closed end; and a housing configured to store the plunger and the protective sleeve when not in use, wherein the plunger comprises a dowel shaped, non-rotatable flexible portion with a proximate end and a distal end and a dowel shaped rigid handle portion with a proximate end and a distal end and a length therein between, the distal end of the rigid handle portion being fixedly attached to the proximate end of the flexible portion by a connection device, and wherein further the protective sleeve is comprised of a water soluble material that is configured to conform to the shape of the dowel shaped flexible portion and at least a portion of the dowel shaped rigid handle portion when the flexible portion is inserted therein, the water soluble material being chemically formulated and mechanically formed to maintain watertight integrity for at least 15 seconds when submerged in water.

2. The pipe clearing system of claim 1, wherein the connection device is a screw like groove-and-land connector.

3. The pipe clearing system of claim 1, wherein the rigid handle portion comprises a gas vent with an inlet and an outlet.

4. The pipe clearing system of claim 1, wherein one of a width or a diameter of the rigid handle portion varies along its length.

5. The pipe clearing system of claim 4, further comprises a slidable ring with an inside diameter circumscribing the rigid handle portion, wherein the inside diameter of the slideable ring is smaller than the diameter of the rigid handle portion at least one location along its length.

6. The pipe clearing system of claim 5, wherein the slidable ring freely slides along the length of the rigid handle portion between its proximate end and the at least one location along its length where the inside diameter of the slideable ring is smaller than the diameter of the rigid handle portion.

7. The pipe clearing system of claim 5, wherein the inlet of the gas vent is located on the distal side of the at least one location along the length of the rigid handle portion.

8. The pipe clearing system of claim 1, wherein the housing is defined by a wall with an interior surface, an exterior surface, a top edge, and a bottom edge, the wall having protrusion perpendicularly affixed thereto proximate the top edge, wherein further the protrusion removably couples to the protective sleeve when not in use.

9. The pipe clearing tool of claim 1, wherein the diameter of the rigid handle is uniform along its entire length.

10. The pipe clearing tool of claim 1, wherein the diameter of the plunger is uniform along its entire length.

11. A pipe clearing tool comprising:

a protective sleeve with an open end and a closed end; and a plunger removably inserted into the protective sleeve, wherein the plunger comprises a dowel shaped flexible portion with a proximate end and a distal end and a dowel shaped rigid handle portion with a proximate end and a distal end and a length therein between, the distal end of the rigid handle portion being fixedly attached to the proximate end of the flexible portion by a connection device, and wherein further the protective sleeve is comprised of a water soluble material that conforms to the shape of the dowel shaped flexible portion and at least a portion of the rigid handle portion when the flexible portion is inserted therein, the water soluble material being chemically formulated and mechanically formed to maintain its watertight integrity for at least 15 seconds when submerged in water.

12. The pipe clearing tool of claim 11, wherein the protective sleeve comprises a perforated tab extending above the open end, a perforation in the perforated tab being configured to adjacently couple the plunger and the protective sleeve via one of a hook or peg.

13. The pipe clearing tool of claim 11, further comprising an elastomeric ring circumscribing the ridged handle portion and slideable along its length, the elastomeric ring having an inside diameter when relaxed.

14. The pipe clearing tool of claim 13, wherein the proximate end of the rigid handle includes circumferential notch with an upper lip and a lower lip that is sized to releasably capture and hold the elastomeric ring at its inside diameter.

15. The pipe clearing tool of claim 11, wherein the diameter of the rigid handle portion is not uniform from its distal end to the connection device.

16. The pipe clearing tool of claim 11, wherein the diameter of the rigid portion decreases from its proximate end to the connection device.

17. A pipe clearing tool comprising:

a protective sleeve with an open end and a closed end; and a plunger removably inserted into the protective sleeve, wherein the plunger comprises a dowel shaped flexible portion with a proximate end and a distal end and a dowel shaped rigid handle portion with a proximate end and a distal end and a length therein between, the distal end of the rigid handle portion being fixedly attached to the proximate end of the flexible portion by a connection device and the proximate end of the rigid handle portion having a crossbar attached thereto with two projecting ends, and wherein further the protective sleeve is comprised of a water soluble material that is configured to conform to the shape of the dowel shaped flexible portion and at least a portion of the rigid handle portion when the flexible portion is inserted therein, the water soluble material being chemically formulated and mechanically formed to maintain its watertight integrity for at least 15 seconds when submerged in water.

18. The pipe clearing tool of claim 17, wherein the protective sleeve is comprised of a soluble polymer.

19. The pipe clearing tool of claim 18, wherein the protective sleeve includes two diametrically opposed support holes penetrating the protective sleeve near its proximal end, each commensurate in position with one of the projecting ends of the crossbar.

20. The pipe clearing tool of claim 19, wherein a thickness of the protective sleeve is greater along a lower length portion of the protective sleeve than the rest of the protective sleeve.

* * * * *